US005181703A

United States Patent [19]

Gilstad et al.

[11] Patent Number: 5,181,703

[45] Date of Patent: Jan. 26, 1993

[54] APPARATUS FOR INSTALLING WOODEN DECKING

[76] Inventors: Donald C. Gilstad, 117 S. 51st St., Omaha, Nebr. 68124; Dennis J. Gilstad, 7255 E. Baldwin Rd., Grand Blanc, Mich. 48439

[21] Appl. No.: 843,576

[22] Filed: Feb. 27, 1992

[51] Int. Cl.[5] ..... B25B 1/20

[52] U.S. Cl. ..... 269/43; 254/11; 269/25; 269/34; 269/35; 269/254 CS; 269/154; 269/208

[58] Field of Search ..... 269/25, 32, 34, 35, 269/43, 254 CS, 909, 906, 153, 154, 208; 254/11

[56] References Cited

U.S. PATENT DOCUMENTS

| | | | |
|---|---|---|---|
| 636,223 | 10/1899 | Landon | 269/25 |
| 1,018,035 | 2/1912 | De Leeuw | 269/32 |
| 2,947,275 | 2/1960 | Edmonds | 269/25 |
| 3,143,335 | 8/1964 | Lassahn | 254/11 |
| 3,412,991 | 11/1968 | De Naples, Jr. et al. | 269/35 |
| 4,066,250 | 1/1978 | Campbell | 269/43 |
| 4,152,819 | 5/1979 | Conkle | 29/252 |
| 4,635,638 | 1/1987 | Weintraub et al. | 269/25 |
| 4,653,740 | 3/1987 | Meissner | 269/906 |

*Primary Examiner*—J. J. Swann

*Attorney, Agent, or Firm*—William J. Clemens

[57] ABSTRACT

An apparatus for installing wooden deck planks on a supporting frame of joists has an actuator mounted on a base plate with an output shaft movable between an open position and a closed position. A control device is mounted on the frame for selectively controlling the actuator to move the output shaft. A fixed angle clamp is mounted on the base plate and has a leg for engaging an edge of a first deck plank, a sliding angle clamp is attached to the output shaft and has a leg for engaging an edge of a second deck plank, and a spacer plate is slidably mounted on the base plate between the clamps and has a predetermined thickness corresponding to a desired spacing between adjacent deck planks. When the actuator moves the output shaft to the open position, the base plate can be rested on the upper surfaces of the first deck frame and the second unattached deck plank with the fixed angle clamp leg engaging the opposite edge of the first deck plank and the spacer plate extending between the facing edges of the deck planks. When the actuator moves the output shaft to the closed position, the sliding angle clamp engages the opposite edge of the second plank and the spacer abuts the facing edges of the first and second planks.

20 Claims, 3 Drawing Sheets

APPARATUS FOR INSTALLING WOODEN DECKING

BACKGROUND OF THE INVENTION

The present invention relates generally to an apparatus for holding and spacing workpieces and, in particular, to an apparatus for holding wooden decking planks in a spaced apart relationship during installation.

Wooden decks have become a popular addition to houses. Typically, a plurality of posts are inserted into the ground adjacent the house and a frame for supporting decking is attached to the posts. The frame usually includes generally horizontally extending joists to which are attached the deck planks. The deck planks typically are 2×4 or 2×6 pieces of wood, often extending ten feet or more. These planks are fastened to the joists in side-by-side relationship and spaced apart a predetermined distance to permit water drainage and expansion caused by weather changes.

Rarely is a wooden deck plank straight enough to maintain the predetermined distance from the adjacent plank along its entire length. Therefore, at least two persons are required to install such deck planks. Two or more sets of spacers are positioned between a loose plank to be installed and the adjacent fixed plank which was previously attached to the joists. One person holds the loose plank against the spacers in a first location while another person holds the loose plank against the spacers in a second location and fastens the loose plank to the joists. Such an installation procedure can require significant strength on the part of both installers who must bend the plank to straighten it.

SUMMARY OF THE INVENTION

The present invention concerns an apparatus for installing wooden deck planks. The apparatus has a frame including an elongated base plate attached at opposite shorter ends to the bottom edges of a pair of upstanding end plates. A handle extends between upper ends of the end plates and an actuator, such as a compressed air cylinder, is mounted on the base plate. A generally V-shaped cover extends between the end plates and is attached to opposed longer edges of the base plate to enclose the actuator. A fixed angle clamp is attached to the bottom of the base plate adjacent one end and extends downwardly to engage an edge of a first deck plank already attached to a deck frame. A sliding angle clamp is attached to a piston rod of the actuator and extends downwardly through the base plate from the opposite end. A spacer plate is slidably mounted on the piston rod of the actuator and extends downwardly through the center of the base plate to engage facing edges of the first deck plank and a second loose deck plank. The thickness of the spacer plate is selected to determine the spacing between the facing edges of the deck planks. The actuator is detachably coupled to a source of compressed air and a control device is for operating the actuator between an open position and a closed position.

The second deck plank is placed on the deck frame adjacent to the first deck plank and the apparatus according to the present invention is positioned on the upper surfaces and transverse to the deck planks with the fixed angle engaging the opposite edge of the first deck plant. The actuator is operated to move the piston rod from the open position to the closed position and draw the sliding angle clamp against the opposite edge of the second deck plank forcing the facing edges of the deck planks against the spacer plate. Thus, the second deck plank is held straight, parallel to and spaced the desired distance from the first deck plank while it is attached to the deck frame thereby permitting one person to install a wooden deck floor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
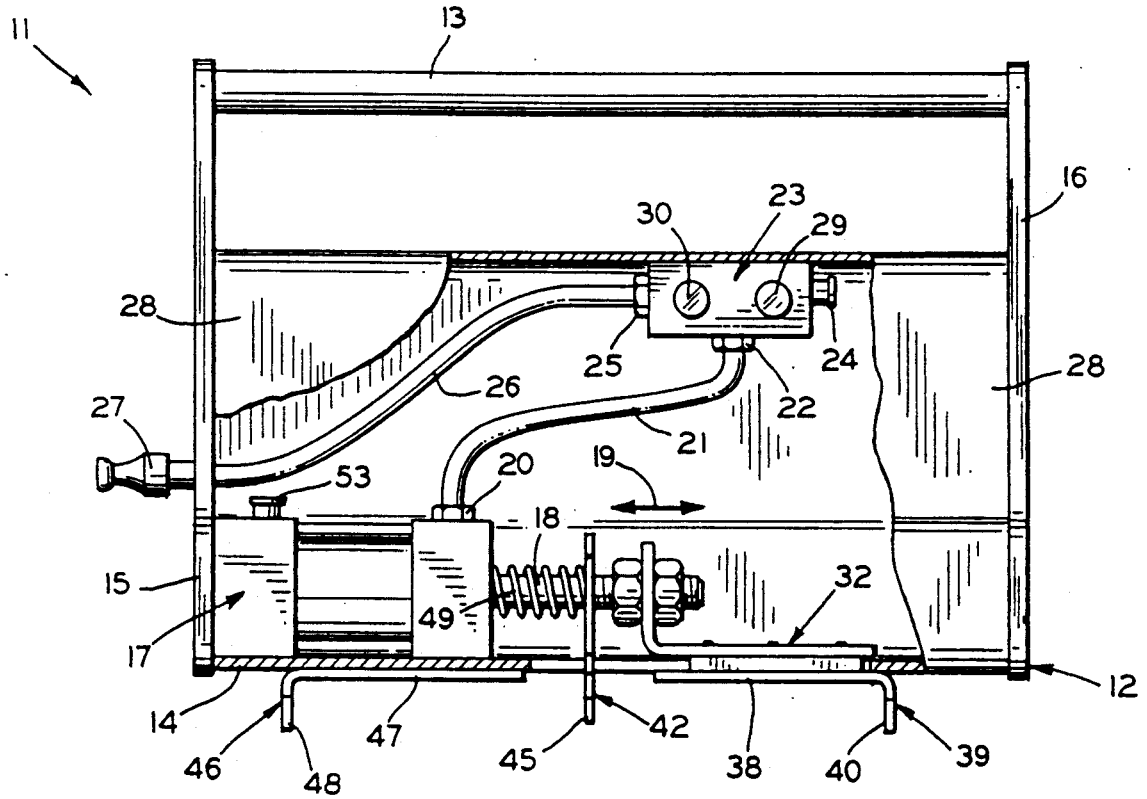
FIG. 1 is a front elevation view of an apparatus for installing wooden decking in accordance with the present invention.
Figure 2:
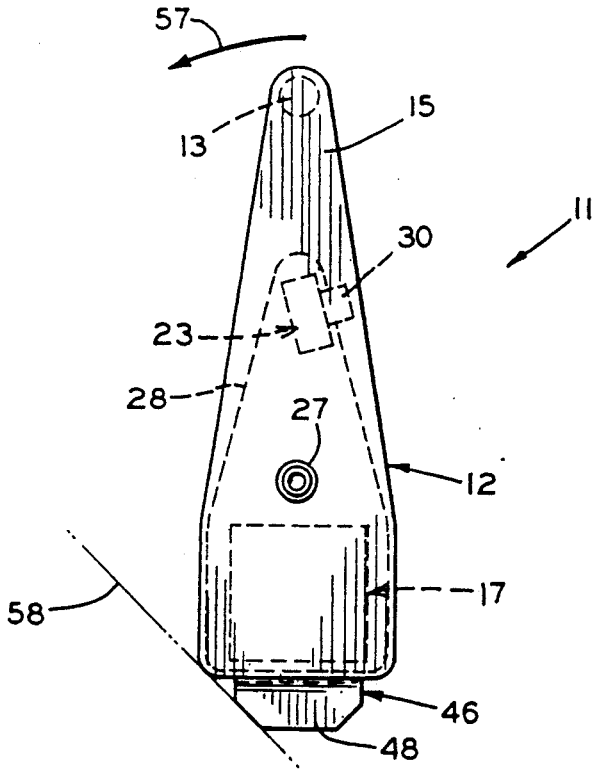
FIG. 2 is a left side elevation view of the apparatus shown in the FIG. 1.

There is shown in the FIGS. 1 and 2 an apparatus 11 for installing wooden deck planks. The apparatus 11 includes a frame 12 having a handle 13 attached thereto. The frame 12 can include a generally rectangular and planar, horizontally extending base plate 14 having end plates attached at opposite shorter ends thereof. For example, the base plate 14 has a left end plate 15 which is generally narrower at the top and wider at the bottom as best shown in the FIG. 2. A bottom edge of the left end plate 15 is attached to one end of the base plate 14 and an upper end of the left end plate 15 is attached to one end of the handle 13. A right end plate 16 is similar to the left end plate 15 and has a wider lower end attached to an opposite end of the base plate 14. An upper narrower end of the right end plate 16 is attached to an opposite end of the handle 13. The handle 13 can be of any suitable shape such as a rod of generally circular cross section.

Mounted on an upper surface of the base place 14 adjacent to the left end plate 15 is an actuator 17. Although the actuator 17 can be any suitable device, an air cylinder operated by compressed air is shown in the preferred embodiment. Extending from a right hand end of the air cylinder actuator 17 is an output means in the form of a shaft 18 shown in an extended or open position. The shaft 18 can be partially retracted into the air cylinder actuator 17 to a closed position (not shown) and extended to the open position shown in the FIG. 1 in the direction of a double headed arrow 19. The shaft 18 is retracted under the influence of compressed air which is supplied to a power supply inlet connector 20 at the right hand end of the air cylinder actuator 17.

Coupled to the inlet connector 20 is one end of an actuator supply line 21. An opposite end of the supply end 21 is coupled to an outlet connector 22 of a control device 23 such as a three-way valve. The valve 23 has a vent 24 and a power supply inlet connector 25. The inlet connector 25 is coupled to one end of an inlet supply line 26 having an opposite end connected to a power supply inlet connector 27. The inlet connector 27 is mounted on an exterior surface of the left end plate 15 and extends through the left end plate to the inlet supply line 26.

The actuator 17, the control device 23 and the associated supply lines 21 and 26 are enclosed by a cover 28 extending between the facing interior surfaces of the left end plate 15 and the right end plate 16. The cover 28 is in the form of a generally inverted V-shape and has a pair of lower edges which are attached to opposed longer edges of the base plate 14. The control device 23 is attached to an inside surface of the cover 28 and includes a pair of actuating buttons which extend through the cover 28. The control device 23 has an "open" actuating button 29 and a "closed" actuating button 30 which are positioned close to the handle 13 for easy actuation by a finger of a hand on the handle.

Figure 4:
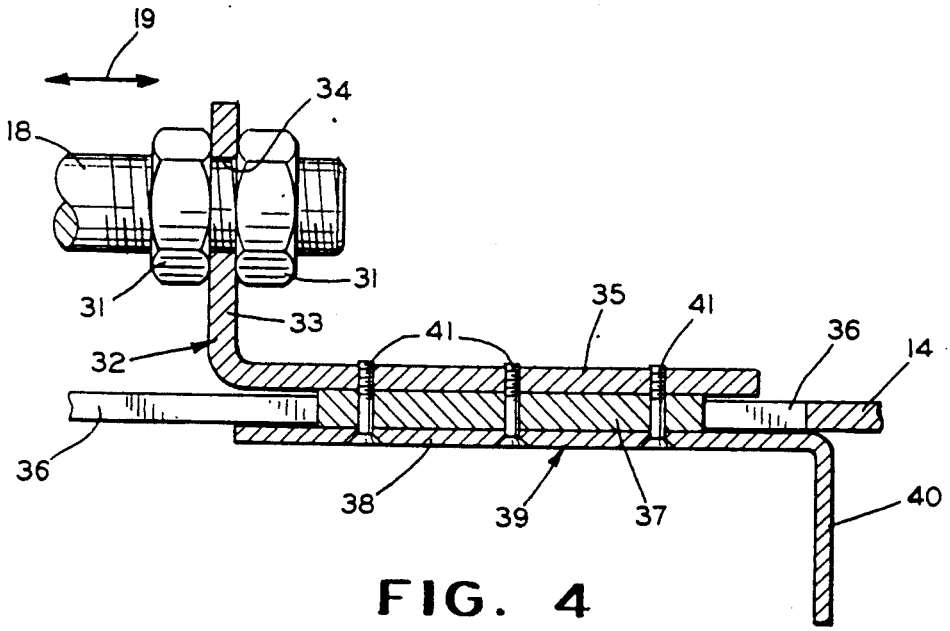
FIG. 4 is an enlarged fragmentary cross-sectional view of the sliding angle clamp shown in the FIG. 1.

The apparatus 11 includes a clamping mechanism having a fixed portion attached to the base plate 14 and a sliding portion which is attached to the shaft 18 of the actuator 17. As shown in the FIGS. 1 and 4, a free end of the shaft 18 is threaded and retains a pair of locking nuts 31. A generally L-shaped angle bracket 32 has a generally vertically extending shorter leg 33 having an aperture 34 formed therein through which the shaft 18 extends. Thus, the angle bracket 32 can be moved back and forth along the threaded end of the shaft 18 to a desired position and locked into place by tightening the nuts 31 on opposite sides of the shorter leg 33. The angle bracket 32 has a longer leg 35 which extends generally parallel to and is spaced above an inner upper surface of the base plate 14. The base plate 14 has a longitudinally extending slot 36 formed therein. A spacer bar 37 is retained in the slot 36 and abuts a lower surface of the longer leg 35 of the angle bracket 32. The spacer bar 37 also extends below an outer lower surface of the base plate 14 and abuts an upper surface of a generally horizontally extending longer leg 38 of a sliding angle clamp 39 which has a generally vertically downwardly extending shorter leg 40. The angle bracket 32, the spacer 37 and the sliding angle clamp 39 are attached together by any suitable means such as a plurality of threaded fasteners 41 which have countersunk heads retained in countersunk apertures formed in the longer leg 38. Each of the threaded fasteners 41 extends through a corresponding aperture formed in the spacer bar 37 and threadably engages a corresponding threaded aperture formed in the longer leg 35 of the angle bracket 32.

Figure 5:
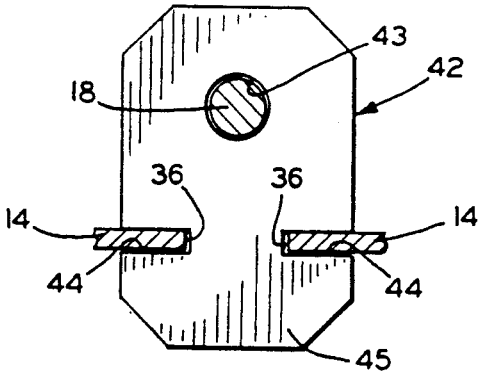
FIG. 5 is an enlarged fragmentary cross-sectional view of the spacer plate shown in the FIG. 1.

A spacer plate 42 is slidably mounted on the base plate 14 as shown in the FIGS. 1 and 5. The spacer plate 42 has an aperture 43 formed therein through which the shaft 18 extends. The diameter of the aperture 43 is somewhat larger than the diameter of the shaft 18 to prevent binding of the spacer plate 42 on the shaft 18 both when the spacer plate 42 is being positioned and when the shaft 18 is being extended and retracted. A pair of generally horizontally extending slots 44 are formed in the spacer plate 42 and extend inwardly from opposite sides thereof. The slots 44 accommodate the base plate 14 and permit the spacer plate 42 to extend downwardly through the slot 36 formed in the base plate 14 and below a lower surface of the base plate 14. As will be discussed below, a lower portion 45 of the spacer plate 42 has a thickness corresponding to the desired predetermined spacing between adjacent planks of a deck floor. In the alternative, the upper portion of the spacer plate 42 can be terminated below the shaft 18 but above the slots 44 and, if additional stability is required, a slider block (not shown) which is wider than the slot 36 could be attached to the upper end of the spacer plate 42 to slide along the upper surface of the base plate 14.

As shown in the FIG. 1, a fixed angle clamp 46 is generally L-shaped and is similar to the sliding angle clamp 39. The fixed angle clamp 46 has a generally horizontally extending longer leg 47 which is fixedly attached to the outer lower surface of the base plate 14. The fixed angle clamp 46 also has a shorter leg 48 which extends vertically downwardly from the bottom surface of the base plate 14. The fixed angle clamp 46 can be attached by any suitable fasteners and various mounting positions can be provided to accommodate different widths of deck planks. A helical return spring 49 can be mounted on the shaft 18 between a face of the actuator 17 and the spacer plate 42 and/or between the spacer plate 42 and the locking nuts 31. If the spacer plate 42 is terminated below the shaft 18, the spring 49 will extend between the actuator 17 and the locking nuts 31.

Figure 3:
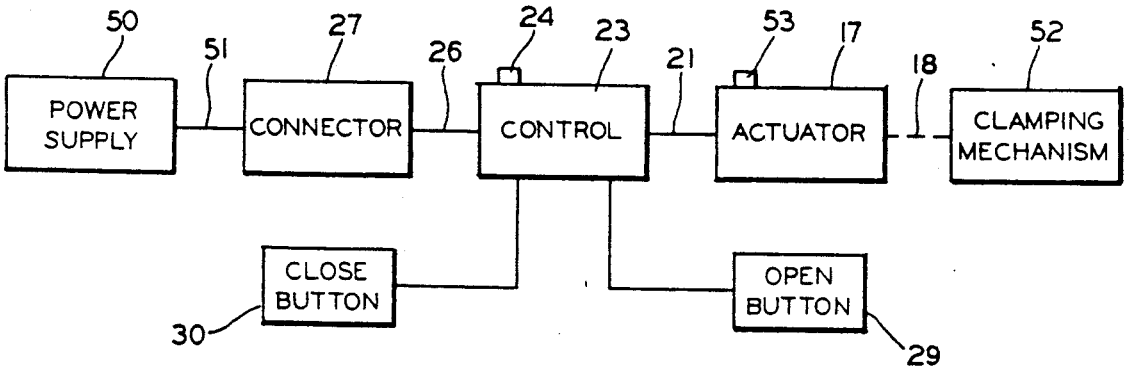
FIG. 3 is a block diagram view of the power supply and control system of the apparatus shown in the FIG. 1.

There is shown in the FIG. 3, a block diagram of the power supply and control systems for the apparatus 11. The actuator 17 is connected by the actuator supply line 21 to the control device 23. In turn, the control device 23 is connected by the inlet supply line 26 to the power supply inlet connector 27. A power supply 50 can be connected by a supply line 51 to the inlet connector 27. In the embodiment shown in the FIGS. 1 and 2, the power supply 50 could be a source of compressed fluid, such as compressed air, coupled by the supply line 51 to the inlet connector 27. The shaft 18 of the actuator 17 is mechanically coupled to a clamping mechanism 52. In the FIGS. 1 and 2, the clamping mechanism 52 includes the sliding angle clamp 39, the spacer plate 42 and the fixed angle clamp 46.

When the power supply 50 has been connected to the inlet connector 27, the closed button 30 can be actuated and the three-way valve control device 23 will permit compressed air to pass from the power supply 50 to the actuator 17 causing the shaft 18 to retract into the actuator 17. The actuator 17 is an air cylinder of conventional design having a piston (not shown) attached to the end of the shaft 18 internal to the actuator 17. As compressed air is introduced through the actuator supply line 21 into the cylinder, the piston will be moved from the right hand end of the actuator cylinder toward the left hand end of the actuator cylinder to retract the shaft 18. Air in the left hand end of the actuator cylinder will be expelled through a vent 53.

When the shaft 18 has been retracted to the closed position, it can be returned to the open position shown in the FIG. 1 by actuating the "open" button 29. The three-way valve control device 23 responds by blocking compressed air from the inlet supply line 26 and connecting the actuator supply line 21 to the vent 24. Now, compressed air in the right hand end of the cylinder of the actuator 17 is free to escape through the actuator supply line 21 and out the vent 24. The shaft 18 can be moved back to the position shown in FIG. 1 either by grasping the sliding angle clamp 39 and pulling it to the right, or under the influence of the return spring 49.

Figure 6:
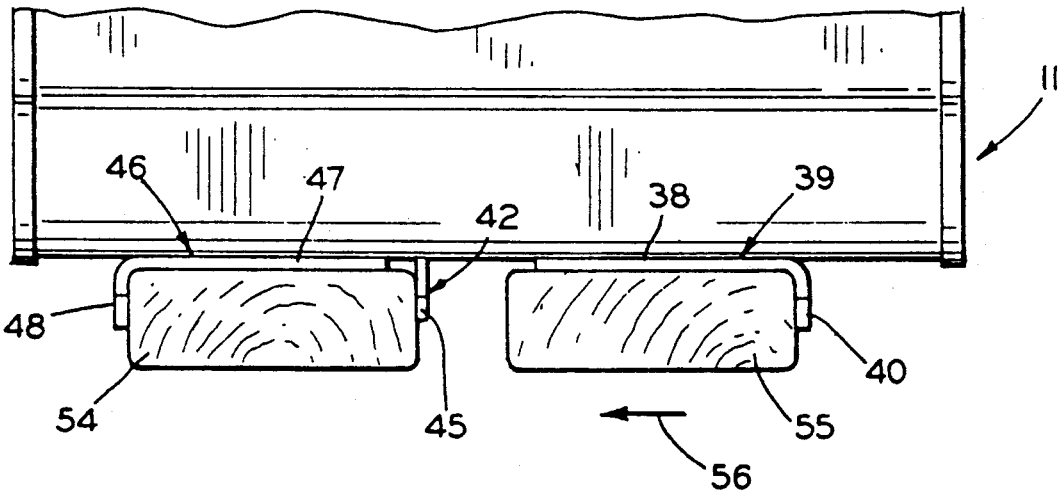
FIG. 6 fragmentary front elevation view similar to the FIG. 1 showing the apparatus in an open position before actuation.
Figure 7:
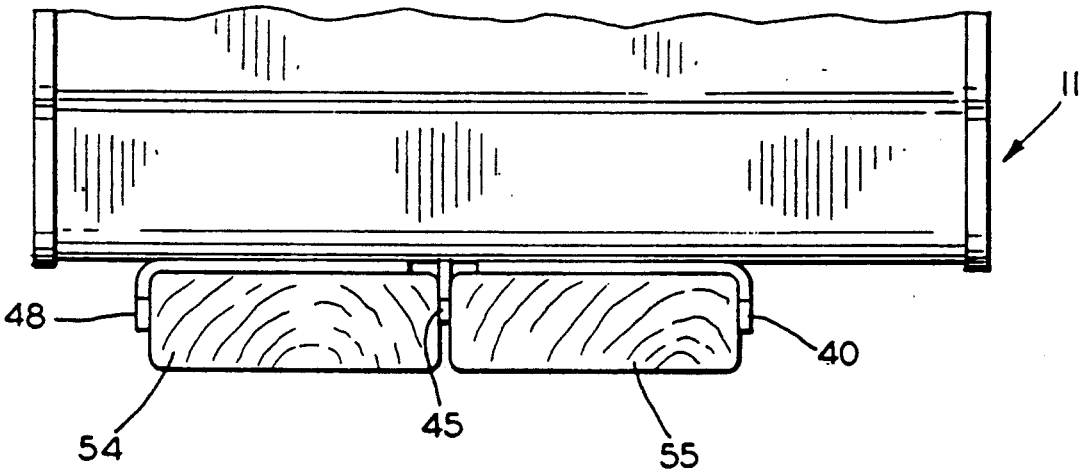
FIG. 7 fragmentary front elevation view similar to the FIG. 6 showing the apparatus in a closed position after actuation.

The operation of the apparatus 11 is illustrated in the FIGS. 6 and 7. There is shown in end view a first deck plank 54 and a second deck plank 55 of a deck floor. Assuming that the first plank 54 is fixedly attached to a frame (not shown) of the deck and the second plank 55 is resting loosely on the frame, the apparatus 11 is lowered onto upper surfaces of the first and second planks in a transverse position. The shorter leg 48 of the fixed angle clamp 46 is positioned abutting an edge of the first plank 54 opposite the edge adjacent the second plank 55 and the longer leg 57 rests on an upper surface of the first plank 54. The spacer plate 42 can be moved such that the lower portion 45 is abutting the edge of the first plank 54 facing the second plank 55. At the same time, the longer leg 38 of the sliding angle clamp 39 rests upon an upper surface of the second plank 55 and the shorter leg 40 abuts an edge of the second plank 55 opposite the edge adjacent the first plank 54. The distance between the lower portion 45 and the shorter leg 40 is greater than the width of the second plank 55 such that a gap exists between the lower portion 45 and the facing edge of the second plank 55.

When the "closed" button 30 is depressed, the actuator 17 retracts the shaft 18 pulling the sliding angle clamp 39 in the direction of an arrow 56 shown in the FIG. 6. As shown in the FIG. 7, the facing edge of the second plank 55 is pulled into abutment with the lower portion 45 and the facing edges of the first plank 54 and the second plank 55 are spaced apart the predetermined distance represented by the thickness of the lower portion 45 of the spacer plate 42. The second plank 55 is held straight and properly spaced and can be attached to the deck frame (not shown). When the second plank 55 has been attached, the "open" button 29 is actuated. As shown in the FIG. 2, the apparatus 11 can be rotated, for example, in the direction of an arrow 57 to release the lower portion 45 of the spacer plate 42 from between the facing edges. As shown by a phantom line 58 representing an upper surface of a plank adjacent to the first plank 54, the apparatus 11 can be rolled on the rounded edges extending between the end plates 15 and 16 to slide the lower portion 45 of the spacer plate 42 from between the first plank 54 and the second plank 55. Thus, the apparatus 11 can be operated by one person utilizing one hand leaving that person free to nail or otherwise fasten the second plank 55 to the deck frame.

Figure 8:
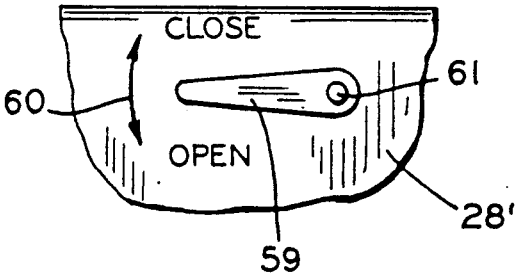
FIG. 8 is an enlarged fragmentary front elevation view of the apparatus showing an alternate embodiment actuator control device.

There is shown in the FIG. 8, an alternate embodiment of the control device 23. Instead of the push buttons 29 and 30, the control device 23 can have a lever 59 positioned on an outer surface of a cover 28'. The lever 59 can be positioned for convenient engagement by a thumb of a hand grasping the handle 13 shown in the FIG. 1. The lever 59 can be rotated in the direction of a double headed arrow 60 about a pivot point 61 representing a point of attachment to and an axis of rotation of a shaft extending from a suitable control device (not shown) mounted inside the cover 28'.

Although the power supply and control system shown in the FIG. 3 has been described in terms of compressed air, any suitable source of energy could be utilized. For example, the power supply 50 could be a source of electrical power, the control 23 could be electrical switching means and the actuator 17 could be a solenoid.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for installing wooden deck planks on a supporting frame of joists comprising:

a base formed as a generally rectangular plate and including a pair of end plates attached at lower ends thereof to opposed shorter edges of said base plate and a handle attached to and extending between upper ends of said end plates;

an actuator mounted on said base and having output means for movement between an open position and a closed position;

a generally inverted V-shaped cover extending between and attached to said end plates and attached to opposed longer edges of said base plate, said cover enclosing said actuator and spaced from said handle;

a fixed clamp mounted on said base for engagement with an edge of a deck plank;

a sliding clamp attached to said actuator output means for engagement with an edge of a deck plank, said sliding clamp being spaced from said fixed clamp by a predetermined distance exceeding the width of two adjacent deck planks when said actuator output means is in the open position; and a spacer slidably mounted on said base between said fixed clamp and said sliding clamp and having a predetermined thickness corresponding to a desired spacing between two adjacent deck planks whereby when said actuator output means is in the open position, said base can be rested on an upper surface of a first deck plank attached to a deck frame and an upper surface of a second unattached deck plank with said fixed clamp engaging an opposite edge of the first deck plank and said spacer extending between facing edges of the first and second deck planks and when said actuator output means is moved toward the closed position, said sliding clamp engages an opposite edge of the second plank and said spacer abuts the facing edges of the first and second planks.

2. The apparatus according to claim 1 wherein said spacer is removably mounted on said base plate.

3. The apparatus according to claim 1 wherein said actuator is an air cylinder and said output means is an output shaft extending from said air cylinder and having a free end attached to said sliding clamp.

4. The apparatus according to claim 1 including a return spring positioned between said actuator and said spacer for returning said output means to the open position.

5. The apparatus according to claim 1 including a return spring positioned between said actuator and said sliding clamp for returning said output means to the open position.

6. The apparatus according to claim 1 including a return spring attached to said actuator for returning said output means to the open position.

7. The apparatus according to claim 1 including a control device having a first power supply inlet connector, a second power supply inlet connector mounted on said base, an inlet supply line connected between said first and second power supply inlet connectors, an outlet connector on said control device, a third power supply inlet connector on said actuator, and an actuator supply line connected between said outlet connector and said third power supply inlet connector whereby said control device selectively controls the actuator when a power supply is connected to said first power supply inlet connector.

8. The apparatus according to claim 7 wherein said actuator is an air cylinder and said control device is a three-way valve having an open button and a closed button.

9. The apparatus according to claim 7 wherein said actuator is an air cylinder and said control device is a three-way valve having a lever movable between an open position and a closed position.

10. The apparatus according to claim 1 wherein said output means is a shaft and said spacer has an aperture formed in an upper portion thereof through which said shaft passes, said aperture having a diameter sufficient to prevent binding of said spacer on said shaft.

11. The apparatus according to claim 1 wherein said base has an elongated slot formed therein and said spacer has a pair of slots extending inwardly from opposite edges thereof, opposed edges of said longitudinal slot extending into associated ones of said spacer slots.

12. The apparatus according to claim 1 wherein said sliding clamp is adjustably attached to said actuator output means for selectively adjusting a spacing between said fixed clamp and said sliding clamp.

13. An apparatus for installing wooden deck planks on a supporting frame of joists comprising:

a base;

an actuator mounted on said base and having output means for movement between an open position and a closed position;

a fixed clamp mounted on said base for engagement with an edge of a deck plank;

a sliding clamp attached to said actuator output means for engagement with an edge of a deck plank, said sliding clamp being spaced from said fixed clamp by a predetermined distance exceeding the width of two adjacent deck planks when said actuator output means is in the open position, said sliding clamp including an angle bracket having a shorter leg attached to said actuator output means and a longer leg, a spacer bar attached to said angle bracket longer leg, and a sliding angle clamp having a longer leg attached to said spacer bar and a shorter leg for engagement with an edge of a deck plank; and a spacer slidably mounted on said base between said fixed clamp and said sliding clamp and having a predetermined thickness corresponding to a desired spacing between two adjacent deck planks whereby when said actuator output means is in the open position, said base can be rested on an upper surface of a first deck plank attached to a deck frame and an upper surface of a second unattached deck plank with said fixed clamp engaging an opposite edge of the first deck plank and said spacer extending between facing edges of the first and second deck planks and when said actuator output means is moved toward the closed position, said sliding clamp engages an opposite edge of the second plank and said spacer abuts the facing edges of the first and second planks.

14. The apparatus according to claim 13 wherein said base has an elongated slot formed therein for slidably retaining said spacer bar.

15. An apparatus for installing wooden deck planks on a supporting deck frame comprising:

a frame having a generally planar base plate with an upper surface and a lower surface;

an actuator mounted on said frame above said base and having an output means movable between a predetermined open position and a predetermined closed position in response to connection to a power supply;

"a handle attached to said frame extending upwardly from said actuator for positioning and maintaining said base plate lower surface on a first deck plank attached to a supporting deck frame;

a control device mounted on said frame and connected to said actuator for connecting said actuator to a power supply and selectively controlling said actuator to move said output means between said open position and said closed position;

a fixed clamp mounted on said frame and having a leg extending below said base plate lower surface for engagement with an edge of the first deck plank;

a sliding clamp attached to said output shaft and having a leg extending below said lower surface for engagement with an edge of an unattached second deck plank positioned on the supporting deck frame and adjacent to the first deck plank; and a spacer plate slidably mounted on said frame between said fixed clamp and said sliding clamp and extending below said base plate lower surface and having a predetermined thickness corresponding to a desired spacing between the adjacent first and second deck planks whereby when said control device controls said actuator to move said output means to said open position, said base plate lower surface can be placed on an upper surface of the first deck plank and on an upper surface of the second deck plank, the first and second deck planks each having a facing edge and an opposite edge, with said fixed clamp leg engaging the opposite edge of the first deck plank and said spacer plate extending between the facing edges of the first and second deck planks, and when said control device controls said actuator to move said output means toward said closed position, said sliding clamp leg engages the opposite edge of the second plank and forces the facing edges of the first and second planks into abutment with said spacer plate.

16. The apparatus according to claim 15 including a return spring positioned between said actuator and said sliding clamp for returning said output means to said open position.

17. The apparatus according to claim 15 wherein said sliding clamp is adjustably attached to said actuator output means for selectively adjusting a spacing between said fixed clamp and said sliding clamp in said open position.

18. The apparatus according to claim 15 wherein said frame has a pair of generally rounded edges formed along opposite sides of said base plate and extending generally parallel to a path of travel of said output means between said open position and said closed position.

19. The apparatus according to claim 15 wherein said base plate is a generally rectangular plate and including a pair of end plates attached at lower ends thereof to opposed shorter edges of said base plate, wherein said handle is attached to and extends between upper ends of said end plates, and including a cover extending between said end plates and attached to opposed longer edges of said base plate, said cover enclosing said actuator and being spaced from said handle.

20. The apparatus according to claim 15 wherein said actuator is an air cylinder and said output means is an output shaft extending from said air cylinder and having a free end attached to said sliding clamp, wherein said control device includes a three-way valve having a first power supply inlet connector, a second power supply inlet connector mounted on said base, an inlet supply line connected between said first and second power supply inlet connectors, an outlet connector on said valve, a third power supply inlet connector on said actuator, and an actuator supply line connected between said outlet connector and said third power supply inlet connector whereby said valve selectively controls said actuator when a power supply is connected to said first power supply inlet connector.

* * * * *